US011472682B2

(12) United States Patent
Roeth et al.

(10) Patent No.: US 11,472,682 B2
(45) Date of Patent: Oct. 18, 2022

(54) QUICK RELEASE HOIST SYSTEM

(71) Applicant: Honda Motor Co., Ltd., Tokyo (JP)

(72) Inventors: Gregory Ethan Roeth, Sidney, OH (US); Stephen Wade Pennington, Bellefontaine, OH (US)

(73) Assignee: Honda Motor Co., Ltd., Tokyo (JP)

( * ) Notice: Subject to any disclaimer, the term of this patent is extended or adjusted under 35 U.S.C. 154(b) by 5 days.

(21) Appl. No.: 17/158,456

(22) Filed: Jan. 26, 2021

(65) Prior Publication Data

US 2022/0234870 A1 Jul. 28, 2022

(51) Int. Cl.

| | |
|---|---|
| ***B66D 1/00*** | (2006.01) |
| ***B66D 1/44*** | (2006.01) |
| ***B66D 5/28*** | (2006.01) |
| ***B66D 3/26*** | (2006.01) |

(52) U.S. Cl.

CPC ..... *B66D 1/44* (2013.01); *B66D 3/26* (2013.01); *B66D 5/28* (2013.01); *B66D 2700/023* (2013.01)

(58) Field of Classification Search

CPC ... B66D 1/44; B66D 3/26; B66D 5/26; B66D 2700/025

See application file for complete search history.

(56) References Cited

U.S. PATENT DOCUMENTS 2,981,289 A * 4/1961 Martin ..... B66D 3/22 92/135
3,125,200 A * 3/1964 Kaman ..... B66D 3/22 254/378
3,656,715 A * 4/1972 Powell ..... B66D 3/18 254/331
3,758,079 A * 9/1973 Workman, Jr. ..... B66D 3/18 254/377
3,773,296 A * 11/1973 McKendrick ..... B66D 3/18 254/386
4,261,451 A * 4/1981 Strong ..... B66D 1/44 254/367
4,372,534 A 2/1983 Hansson
(Continued)

FOREIGN PATENT DOCUMENTS

CN 2288960 Y * 8/1998
CN 2918370 Y * 7/2007
(Continued)

OTHER PUBLICATIONS

Espacenet Machine Translation of CN Patent No. 102633200 B.
Espacenet Machine Translation of CN Patent No. 103612988 B.

*Primary Examiner* — Emmanuel M Marcelo
(74) *Attorney, Agent, or Firm* — Plumsea Law Group, LLC

(57) ABSTRACT

A hoist system including an air balancer having an air supply and an air exhaust, a lifting device, and a hoist control pendant to control supply and exhaust of pressurized air to and from the air balancer, respectively, the hoist control pendant configured to control vertical movement of the lifting device. The air exhaust from the air balancer includes a first exhaust flow path through a first exhaust opening and a second exhaust flow path through a second exhaust opening, the first exhaust flow path having a first length and the second exhaust flow path having a second length, the second length being shorter than the first length.

18 Claims, 5 Drawing Sheets

(56) References Cited

U.S. PATENT DOCUMENTS

| | | | | | |
|---|---|---|---|---|---|
| 4,434,974 | A * | 3/1984 | LaCount | B66D 3/20 | 188/170 |
| 4,534,476 | A | 8/1985 | Burchfield et al. | | |
| 2001/0045549 | A1 * | 11/2001 | Johnson | B66D 1/485 | 91/384 |
| 2010/0108965 | A1 * | 5/2010 | Fujii | B66D 5/26 | 254/277 |

FOREIGN PATENT DOCUMENTS

| | | | | |
|---|---|---|---|---|
| CN | 102633200 | B | 12/2013 | |
| CN | 103612988 | B | 5/2015 | |
| CN | 108661972 | A * | 10/2018 | F15B 13/0401 |
| EP | E P-0040184 | A2 * | 11/1981 | |

* cited by examiner

QUICK RELEASE HOIST SYSTEM

BACKGROUND

1. Field of the Disclosure

The present disclosure relates to hoist system and, more particularly, to a pneumatic hoist system with a quick release mechanism.

2. Description of Related Art

Pneumatic balancing hoists are well established as a standard in the materials handling industry. These pneumatic balancing hoists or air balancers, have been used for years to move work pieces about a factory or industrial site. Pneumatic balancing hoists are also used in an assembly line operation to facilitate the placement of multiple components in a machine or device. The process time on the assembly line can include a number of assembly steps such as, for example, the time for the hoist to retrieve the component from a conveyor, the time for the operator to install the component, and the time for the hoist to be released from the installed component and move back to the conveyor to repeat the component retrieval process. Each of these assembly steps can be a potential issue for desired cycle time not being achieved.

After the component has been installed, the air within the pneumatic hoist must be exhausted so that there is sufficient slack in the hoist cable for release from the installed component and the hoist can then move downwards back towards the conveyor. Typically, however, exhaust of the air is limited to an exhaust port in the hoist control pendent, thereby requiring the air to travel the length of the airline from the hoist to the control pendant before it can be exhausted.

There is a need in the art for a system and method that decreases the release time of a pneumatic hoist in an effort to improve overall cycle time in an assembly line operation.

SUMMARY OF THE INVENTION

According to the disclosure herein, a "quick exhaust" system is added to a pneumatic hoist utilizing a plurality of pilot valves. The quick exhaust system allows a user to temporarily bypass the exhaust through the pendant control once a load (i.e., the component to be moved) is no longer on the hoist and utilize an exhaust port provided by the pilot valve. The quick release of pressure to lower the hoist can be improved by increasing the air flow on the exhaust side of the hoist. Hence, the exhaust port provided by the pilot valve allows the air from the hoist to exhaust more quickly and thus improves the release time and overall cycle time for the hoist operation.

In one aspect, the disclosure provides a hoist system having an air balancer having an air supply and an air exhaust; a lifting device; and a hoist control pendant to control supply and exhaust of pressurized air to and from the air balancer, respectively, the hoist control pendant configured to control vertical movement of the lifting device. The air exhaust from the air balancer includes a first exhaust flow path through a first exhaust opening and a second exhaust flow path through a second exhaust opening, the first exhaust flow path having a first length and the second exhaust flow path having a second length, the second length being shorter than the first length.

The disclosure herein further provides an air balancer for a pneumatic hoist system having a housing including opposing end walls and a cylindrical casing extending therebetween; a piston slidably disposed within the cylindrical casing so as to define an air chamber proximate one of said opposing end walls; a mechanical linear actuator extending longitudinally through the housing and actuated by the piston; an inlet for air to be supplied into the air chamber; and an exhaust system controlling air to be exhausted from the air chamber. The exhaust system defines a first exhaust flow path and a second exhaust flow path, the second exhaust flow path exhausting a greater volume of air than the first exhaust flow path in a predetermined period of elapsed time.

In another aspect, the disclosure provides a method of pneumatic hoist operation including providing a pneumatic hoist having an air balancer, a lifting cable hoist, and a hoist control pendant, wherein the hoist control pendant includes an up direction control, a down direction control, and a quick release down control; actuating the up control on the hoist control pendant to raise the lifting cable in an upwards direction; actuating the down control on the hoist control pendant to lower the lifting cable in a downwards direction at a first rate of descent; and actuating the quick release control on the hoist control pendant to lower the lifting cable in a downwards direction at a second rate of descent; wherein the second rate of descent is greater than the first rate of descent.

Other systems, methods, features and advantages of the disclosure will be, or will become, apparent to one of ordinary skill in the art upon examination of the following figures and detailed description. It is intended that all such additional systems, methods, features and advantages be included within this description and this summary, be within the scope of the disclosure, and be protected by the following claims.

BRIEF DESCRIPTION OF THE DRAWINGS

The disclosure can be better understood with reference to the following drawings and description. The components in the figures are not necessarily to scale, emphasis instead being placed upon illustrating the principles of the disclosure. Moreover, in the figures, like reference numerals designate corresponding parts throughout the different views.

DETAILED DESCRIPTION

Heretofore, pneumatic hoists have usually relied upon the hoist control pendant to exhaust air from the hoist. The exhaust port in the control pendant requires the air to travel an extended distance from the air balancer to the control pendant, for example, approximately 12 feet or so. This extended air flow path to reach the exhaust port thus impedes the overall assembly line process because it slows down the time to release the hoist from the component being moved, and thereby decreases the cycle time for the hoist operation. According to the disclosure herein, a "quick exhaust" system is added to a pneumatic hoist utilizing a plurality of pilot valves. The quick exhaust system allows a user to temporarily bypass the exhaust through the pendant control once a load (i.e., the component to be moved) is no longer on the hoist and utilize a relatively close, nearby exhaust provided by the pilot valve. The nearby exhaust valve allows the air from the hoist to exhaust more quickly and thus improves the release time and overall cycle time for the hoist operation.

Figure 1:
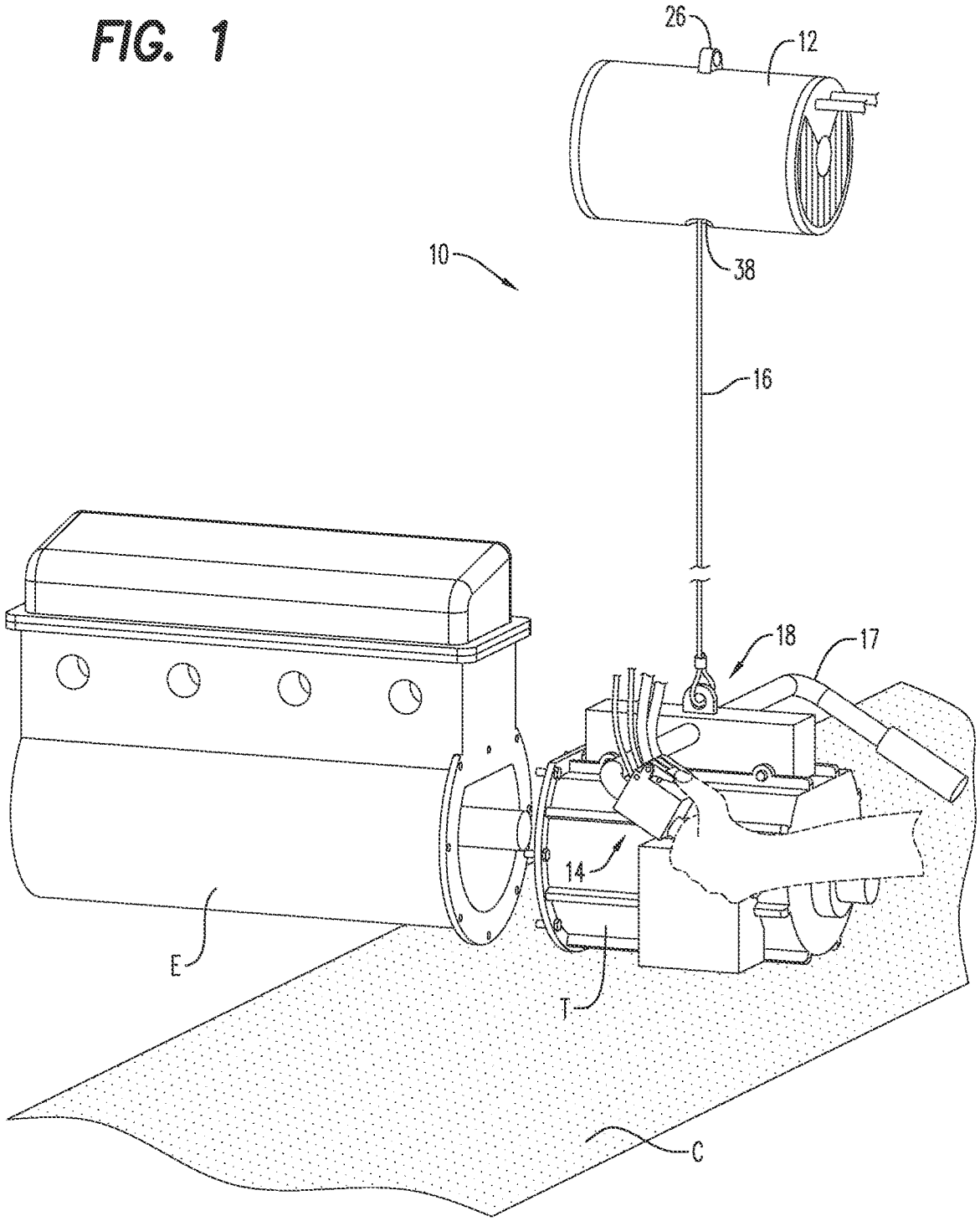
FIG. 1 is a schematic view of a quick release pneumatic hoist system according to an exemplary embodiment of the disclosure illustrated in an assembly line for installing a component onto a machine.

A hoist system according to an exemplary embodiment of the disclosure is shown generally in FIG. 1 by reference numeral 10. The hoist system 10 includes an air balancer 12 operated by a hoist control pendent 14. Extending downward from the air balancer 12 is a suspension structure such as a hoist lifting cable 16, chain, or similar support mechanism connecting the air balancer 12 to an associated handling device 17 for moving the load or component 18. An overhead support such as a trolley movable on a rail or track system or some other fixed or movable structure (not shown) connects to the housing 20 at a suspension lug 26 or similar connection element. In particular, such a hoist system 10 can be used to raise a component 18, such as a transmission T, from a conveyor C, slide the component 18, onto a machine such as an engine E, and then release the handling device 17 from the component 18 so that it can be lowered back to the conveyor C and the cycle can be repeated. The movement of a component 18 with such a pneumatically-operated hoist is well-known in the art.

Figure 2:
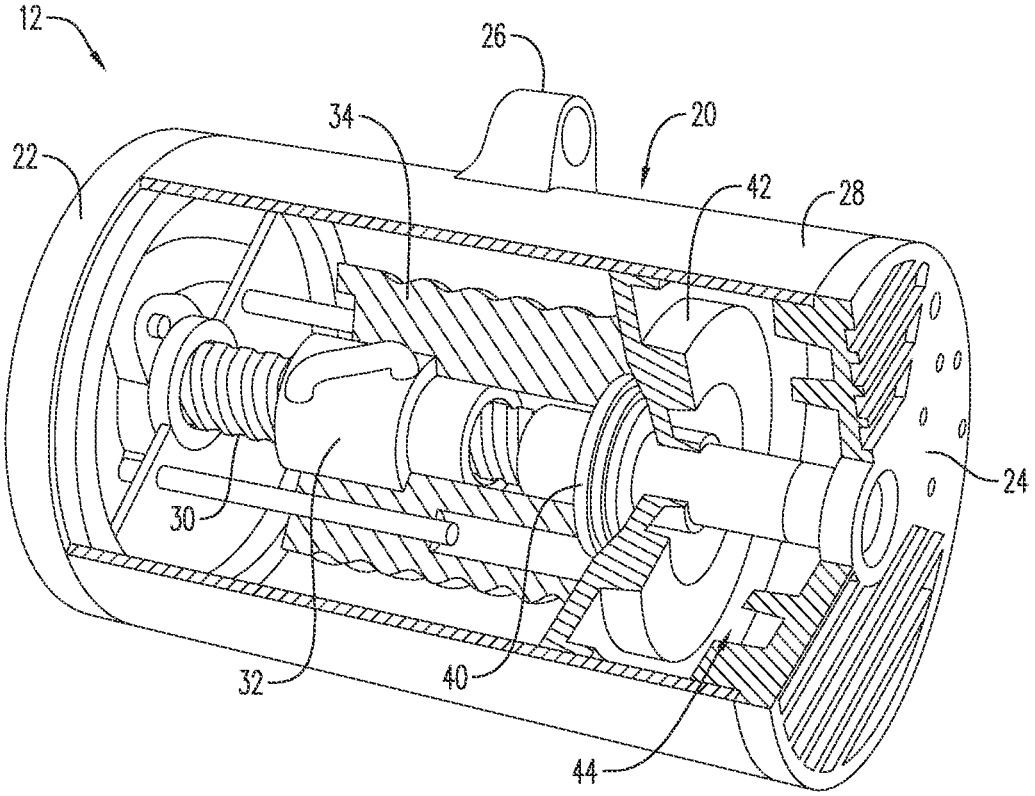
FIG. 2 is a partial cut-away view of an air balancer for the quick release pneumatic hoist system according to an exemplary embodiment of the disclosure.

Referring also to FIG. 2, the air balancer 12 includes a housing 20 having opposing end walls 22, 24 and a hollow cylindrical casing 28 therebetween. A mechanical linear actuator that translates rotational motion to linear motion, such as ball screw 30, extends longitudinally through the housing 20. A ball screw assembly 32 is mounted on the ball screw 30 and moves longitudinally within the housing 20 when turned relative to the ball screw 30. Ball screw assemblies 32 of this nature are well-known in the art and no further discussion is required herein. A rotating cable drum or reel 34 is mounted on the ball screw assembly 32 and moves on the ball screw 30 both rotatably and longitudinally relative to the ball screw 30. The rotating cable reel 34 has a shallow helical groove 36 that receives the lifting cable 16 when the component 18 is raised and the lifting cable 16 is wound on the rotating reel 34. As the reel 34 moves rotatably and longitudinally within the housing 20, the lifting cable 16 is wound or unwound about the rotating cable reel 34 for raising and lowering loads. Whether the lifting cable 16 is wound or unwound will obviously depend on the direction of the movement of the load being up or down. The lifting cable 16 exits through a housing aperture 38 to the handling device 17 or a hooking mechanisms of any type used for attachment to the component 18 to be moved.

A hub portion 40 of the rotating cable reel 34 is mounted on an extension of the rotating cable reel 34 in order to bear against a piston 42. The piston 42 slides on the inner surface of the casing 28 so as to tightly seal the air in a chamber 44 formed within the housing 20. Hence, the end wall 24, the cylindrical casing 28, and the piston 42 define an air chamber 44 within the housing 20 to receive air for operating the hoist system 10. When pressurized air is supplied to the chamber 44, the piston 42 is moved longitudinally through the housing 20 and forces the rotatable cable reel 34 and the ball screw assembly 32 in the same longitudinal direction, i.e., from right to left as illustrated in FIG. 2. During this longitudinal movement of the piston 42, the ball screw assembly 32 also causes the reel 34 to rotate in a manner to raise and lower the lifting cable 16 and the attached load or component 18. The flow of pressurized air supplied to and expelled from the chamber 44 is discussed in further detail below. Further, while air is discussed herein as the working fluid within the hoist system 10, one skilled in the art will recognize that other gases could also be used if required by the particular working environment.

Figure 3:
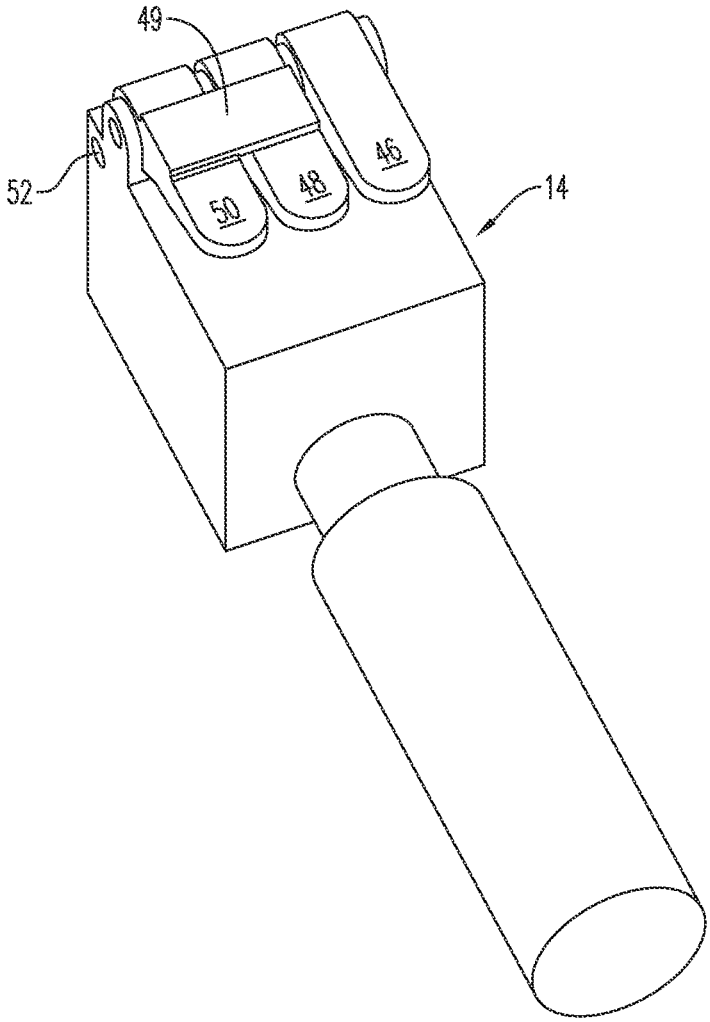
FIG. 3 is a schematic view of a hoist control pendant for the quick release pneumatic hoist system according to an exemplary embodiment of the disclosure.
Figure 4:
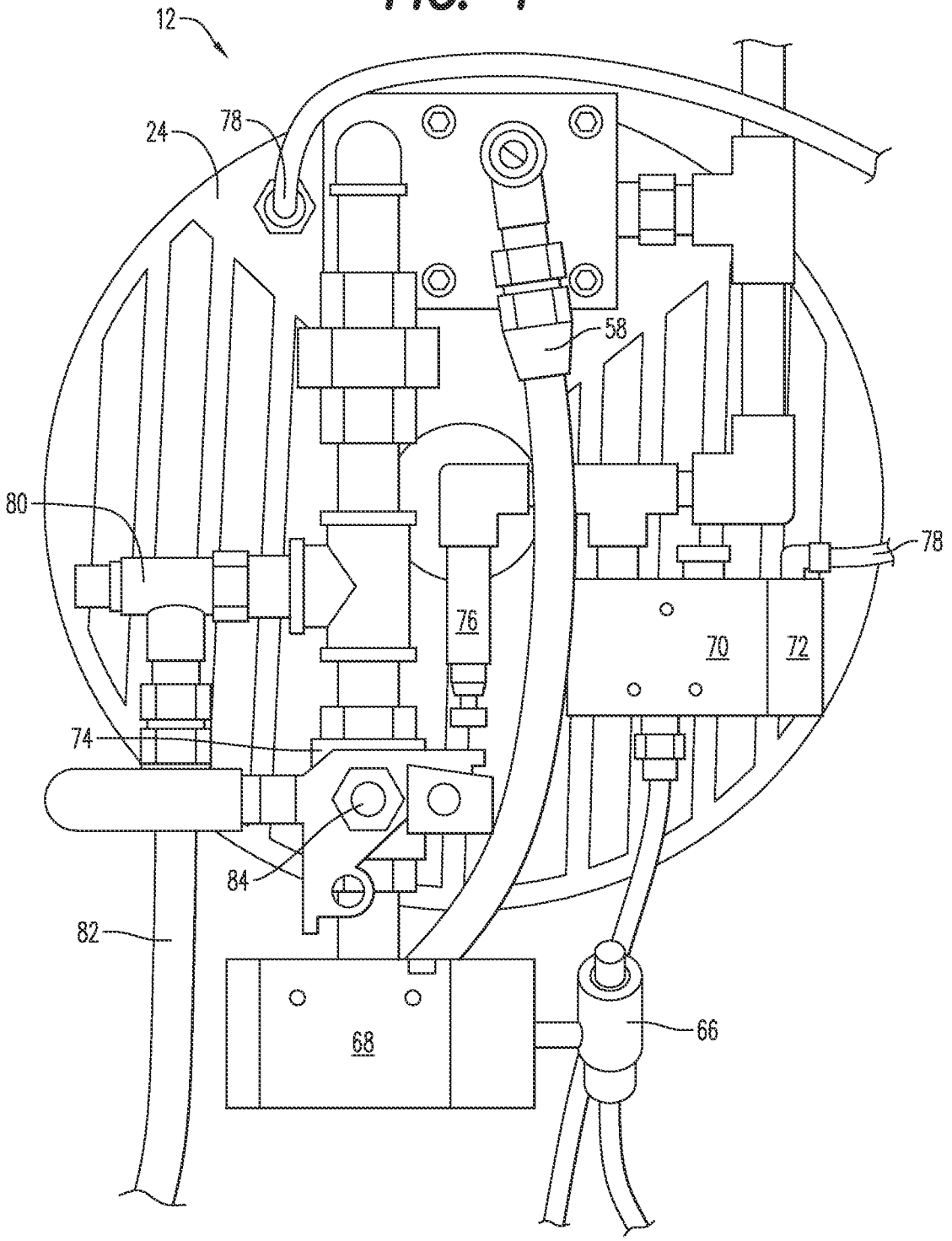
FIG. 4 is a schematic end view of the air balancer for the quick release pneumatic hoist system according to an exemplary embodiment of the disclosure.

Referring also to FIG. 3, the hoist 10 may be operated with the hoist control pendant 14 to move the component 18 in either an up direction by depressing the control button 46 or in a down direction by depressing the control button 48 or in a down direction in a faster mode of operation by depressing the "quick release" control button 50. The selection of either the up button 46, the down button 48 or the quick release button 50 controls the air flow within the pneumatic circuit. The hoist system 10 according to the disclosure herein increases the exhaust flow from the air balancer 12, thus improving the release time of the handing device 17 from the component 18 and expediting the downward movement of the cable 16, while not affecting the upward movement of the hoist system. This is accomplished, in general terms, by temporarily bypassing the normal air exhaust 52 through the control pendant 14 and providing a closer exhaust opening by way of exhaust valve 68 mounted on the end wall 24 of the air balancer 12, as shown in FIG. 4. In a predetermined period of time after depressing the exhaust button, exhaust valve 68 exhausts a given volume of air more quickly than the gas exhaust port 52 due to its close proximity to the air balancer 12, thus obtaining a quicker release of the hoist system 10 from the component 18 after it has been installed.

Figure 5:
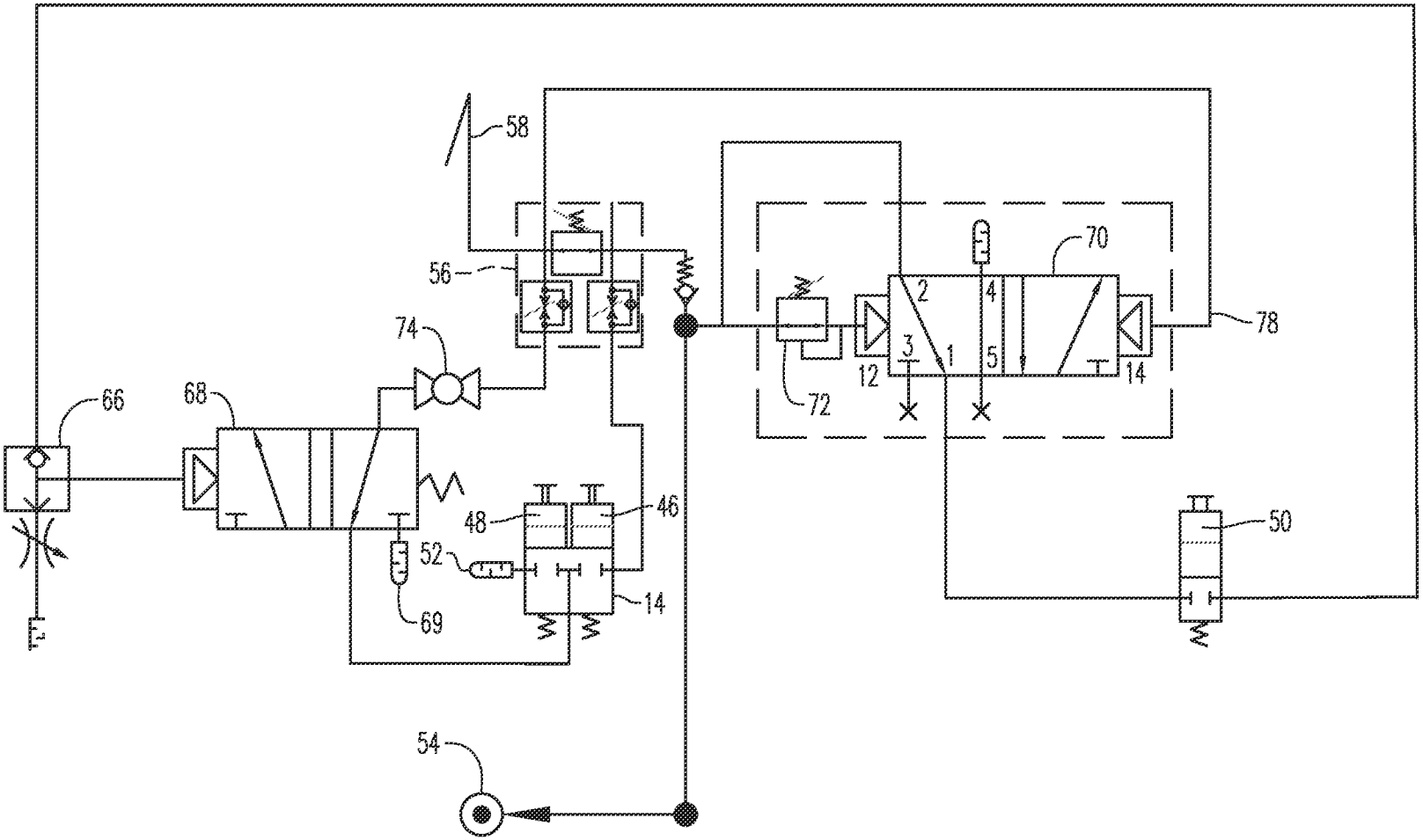
FIG. 5 is an air flow schematic for the quick release pneumatic hoist system according to an exemplary embodiment of the disclosure.

A better understanding of the gas flow through the pneumatic circuit may be had by reference to the flow schematic shown in FIG. 5 and the air balancer 12 shown in FIG. 4. Therein, it may be seen that pressurized gas, such as air, is provided from a source 54 through an up/down control block 56, and by activation of the up button 46 the gas passes into the end the wall 24 of the air balancer 12 through air supply inlet 58. This causes the piston 42 to move longitudinally through the housing 20, thus causing the cable 16 to rotate and lift the component 18.

After the component 18 has been installed and it desired to lower the hoist system once again, the down button 48 is depressed or the quick release button 50 is depressed, which also simultaneously depresses button 48 due to the presence of a bridge 49 between the button 50 and the button 48. If only the button 48 is depressed, gas will exhaust from the air balancer 12 via exhaust flow control fitting 80, and through the length of exhaust flow path 82 and return to the control pendant 14 to be expelled through exhaust port 52.

On the other hand, if no load is on the hoist, and the quick release button 50 is depressed, the gas will be exhausted through nearby pilot valve 68 having an exhaust opening 69 so as to increase the speed at which the air is exhausted and increase the release rate of the hoist. More particularly, an exemplary embodiment of the disclosure utilizes a pilot valve 70, such as a dual pilot valve, to allow the quick release button 50 to operate the exhaust valve 68, such as a three-way single air pilot spring return valve or similar element. The dual pilot valve 70 in combination with a load check device or switch 72 confirms that there is no load on the hoist 10 before allowing it to quickly descend. An air regulator 76, and more particularly, a relieving air regulator, is set to a predetermined pressure generally corresponding to no load being on the hoist, i.e., the weight of the component 18 has been removed. Similar devices for pressure regulation, such as a pressure gauge for example, could also be used instead of the air regulator. If the load check switch 72 determines the load 78 (i.e., pressure) from the hoist is less than the preset amount on the air regulator 76, then the pilot valve 70 allows the quick release button 50 to operate the exhaust valve 68. That is, the downward force on the lifting cable 16 is not exerting a pressure greater than the predetermined pressure on the air balancer 12. The load at which the air balancer 12 allows the quick release 50 to operate is set through an empirical process. The load on the hoist 10 is set and the air regulator 76 is adjusted until the hoist 10 does not allow the quick release to be actuated when it is under load. The load is determined by the tension on the cable 16 from whatever is being lifted. The tension on the cable applies rotational force to the ball screw 32 in the air balancer 12 which applies a force on the piston 42. The piston 42 compresses the air which then translates to an air pressure increase.

The exhaust valve 68 defines an exhaust opening closer in proximity to the air balancer 12 than the exhaust port 52 found on the control pendant 14, which thus allows the gas within the air balancer 12 to be rapidly dispelled and the lifting cable 16 lowered at a greater speed. Hence, the hoist release rate is increased and the process time for the assembly line is improved. A one-way check valve 66 is provided to function as a speed exhaust controller and facilitates the rapid downward movement of the hoist in a smooth manner.

If the quick release button 50 is depressed, but there is a load 78 on the hoist determined by the load check switch 72 to be greater than the set point of the air regulator 76, then the pilot valve 70 will not open to allow the gas to exhaust through the exhaust valve 68. Rather, the gas will be exhausted through the exhaust port 52 on the control pendant 14 until the pressure on the hoist decreases to a value below the set point of the air regulator 76. Thereafter, when no load is on the hoist as evidenced by a pressure less than the set point of the regulator 76, the pilot valve 70 will then allow the release button 50 operate the exhaust valve 68.

In an exemplary embodiment of the disclosure, the hoist system 10 further includes a ball valve 74 with a lock out screw 84 which allows the exhaust valve 68 to be manually by-passed if necessary during certain operations.

While various embodiments of the disclosure have been described, the description is intended to be exemplary, rather than limiting and it will be apparent to those of ordinary skill in the art that many more embodiments and implementations are possible that are within the scope of the disclosure. Accordingly, the disclosure is not to be restricted except in light of the attached claims and their equivalents. Also, various modifications and changes may be made within the scope of the attached claims.

We claim:

1. A hoist system comprising:

an air balancer having an air supply and an air exhaust;

a lifting device; and a hoist control pendant to control supply and exhaust of pressurized air to and from the air balancer, respectively, the hoist control pendant configured to control vertical movement of the lifting device;

wherein the air exhaust from the air balancer includes a first exhaust flow path through a first exhaust opening and a second exhaust flow path through a second exhaust opening, the first exhaust flow path having a first length and the second exhaust flow path having a second length, the second length being shorter than the first length.

2. The hoist system according to claim 1, wherein the hoist control pendant includes an up control, a down control, and a quick release control, wherein the down control is configured to be in fluid communication with the first exhaust flow path and the quick release control is configured to be in fluid communication with the second exhaust flow path.

3. The hoist system according to claim 2, wherein the first exhaust opening is provided on the hoist control pendant.

4. The hoist system according to claim 3, further comprising an air exhaust system including a first pilot valve, a load check switch, and a second pilot valve, the second pilot valve including the second exhaust opening.

5. The hoist system according to claim 4, further comprising an air regulator set to a predetermined pressure, wherein the load check switch is configured to compare a pressure exerted by the lifting device to the predetermined pressure.

6. The hoist system according to claim 5, wherein, if the pressure exerted by the lifting device is determined by the load check switch to be less than the predetermined value, the first pilot valve is configured such that actuation of the quick release control expels air within the air chamber through the second exhaust flow path.

7. The hoist system according to claim 6, wherein, if the pressure exerted by the lifting device is determined by the load check switch to be greater than the predetermined value, the first pilot valve is configured such that actuation of the quick release control expels air within the air chamber through the first exhaust flow path until the pressure exerted by the lifting device decreases to a value below the predetermined value.

8. The hoist system according to claim 1, further comprising a rotatable valve to manually bypass the second exhaust flow path.

9. The hoist system according to claim 1, wherein the second exhaust flow path includes a one-way check valve.

10. An air balancer for a pneumatic hoist system comprising:

a housing including opposing end walls and a cylindrical casing extending therebetween;

a piston slidably disposed within the cylindrical casing so as to define an air chamber proximate one of said opposing end walls;

a mechanical linear actuator extending longitudinally through the housing and actuated by the piston;

an inlet for air to be supplied into the air chamber; and an exhaust system controlling air to be exhausted from the air chamber;

wherein the exhaust system defines a first exhaust flow path and a second exhaust flow path, the second exhaust flow path exhausting a greater volume of air than the first exhaust flow path in a predetermined period of elapsed time.

11. The air balancer according to claim 10, wherein the exhaust system includes a load check device for determining if a load from a pneumatic hoist is present.

12. The air balancer according to claim 11, wherein, if no load is determined to be present by the load check device, the exhaust system is configured to expel air within the air chamber through the second exhaust flow path.

13. The air balancer according to claim 12, wherein, if a load is determined to be present by the load check device, the exhaust system is configured to expel air within the air chamber through the first exhaust flow path.

14. The air balancer according to claim 12, wherein the second exhaust flow path includes an exhaust valve disposed on said one of said opposing end walls.

15. The air balancer according to claim 11, wherein the exhaust system further includes a pilot valve, said pilot valve configured to open when the load check device determines no load is present on the hoist.

16. The air balancer according to claim 15, wherein the exhaust system further includes an exhaust valve, the exhaust system configured to expel air through the exhaust valve when said pilot valve is open.

17. A method of pneumatic hoist operation comprising:

providing a pneumatic hoist having an air balancer, a lifting cable hoist, and a hoist control pendant, wherein the hoist control pendant includes an up direction control, a down direction control, and a quick release down control;

actuating the up control on the hoist control pendant to raise the lifting cable in an upwards direction;

actuating the down control on the hoist control pendant to lower the lifting cable in a downwards direction at a first rate of descent;

actuating the quick release control on the hoist control pendant to lower the lifting cable in the downwards direction at a second rate of descent;

wherein the second rate of descent is greater than the first rate of descent;

wherein actuating the down control on the hoist control pendant to lower the lifting cable in the downwards direction at the first rate of descent includes exhausting air from the air balancer through a first exhaust flow path; and wherein actuating the quick release control on the hoist control pendant to lower the lifting cable in the downwards direction at the second rate of descent includes exhausting air from the air balancer through a second exhaust flow path.

18. The method according to claim 17, further comprising providing a load check device for determining if a load from the pneumatic hoist is present, wherein actuating the quick release control includes the load check device determining if the load from the pneumatic hoist is greater than a predetermined value.

* * * * *